United States Patent [19]

Smed et al.

[11] Patent Number: 4,576,548

[45] Date of Patent: Mar. 18, 1986

[54] SELF-ALIGNING STATIC SEAL FOR GAS TURBINE STATOR VANES

[75] Inventors: Jan P. Smed, West Chester, Pa.; Kenneth E. Seitzer, Tempe, Ariz.; Kent G. Hultgren, Swarthmore, Pa.

[73] Assignee: Westinghouse Electric Corp., Pittsburgh, Pa.

[21] Appl. No.: 571,612

[22] Filed: Jan. 17, 1984

[51] Int. Cl.[4] ..... F01D 11/08

[52] U.S. Cl. ..... 415/137; 415/113; 415/174; 415/180; 277/27

[58] Field of Search ..... 415/113, 180, 137, 139, 415/134, 135, 136, 172 A, 174; 277/3, 27, 58

[56] References Cited

U.S. PATENT DOCUMENTS

| | | | |
|---|---|---|---|
| 3,395,645 | 8/1968 | Vilet | 277/27 |
| 3,529,906 | 9/1970 | McLaurin et al. | 415/180 |
| 3,552,753 | 1/1971 | Mierley | 415/117 X |
| 4,328,973 | 5/1982 | Delbridge | 277/27 X |
| 4,385,864 | 5/1983 | Zacherl | 415/136 |

*Primary Examiner*—Abraham Hershkovitz
*Assistant Examiner*—Timothy E. Nauman
*Attorney, Agent, or Firm*—E. C. Arenz

[57] ABSTRACT

An arrangement is provided for statically sealing between the inner shroud 12 of individual stator vanes of a gas turbine, and a seal housing 14 provided with a radially outwardly open channel 22 into which is received a plurality of outer seal segments 24, and which includes a radially outwardly open channel 33 throughout the length of each outer seal segment and with a plurality of inner seal segments received in the channel, with the outer seal segments being biased outwardly by the springs 36, and the inner seal segments 34 being biased outwardly into sealing contact with individual inner shrouds by the concentric inner compression springs 38 carried by the outer seal segments 24.

6 Claims, 4 Drawing Figures

FIG. 2
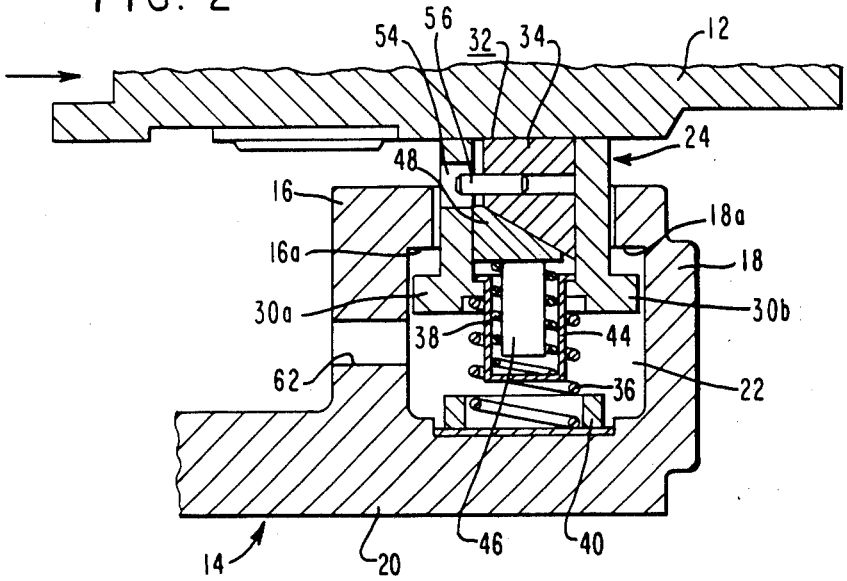
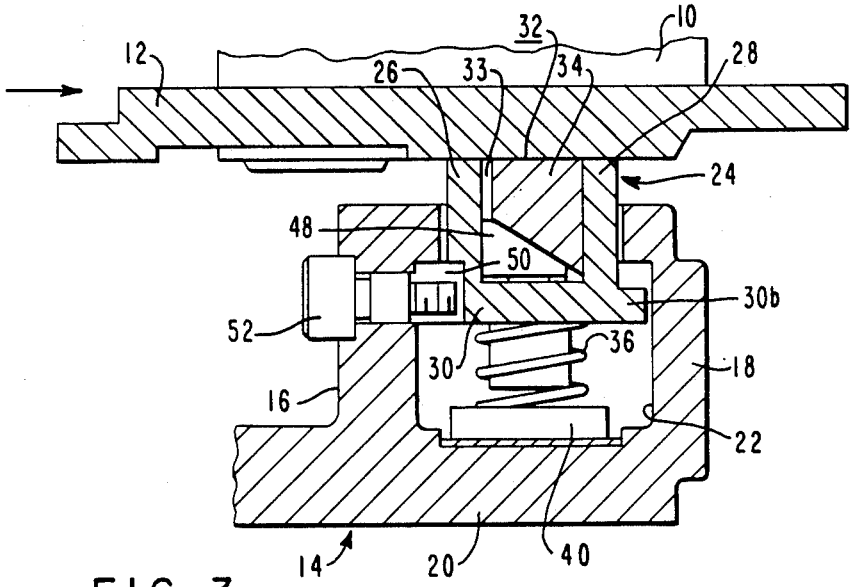
FIG. 3

SELF-ALIGNING STATIC SEAL FOR GAS TURBINE STATOR VANES

BACKGROUND OF THE INVENTION

1. Field of the Invention

This invention pertains to the art of providing a static seal between the inner shrouds of stator vane segments and a radially inner seal housing.

2. Description of the Prior Art

The most pertinent prior art of which we are aware is U.S. Pat. No. 3,529,906 of McLaurin et al and has been embodied substantially as illustrated in gas turbine machines which have been manufactured by the assignee of this application.

As we view it, that design employs a static seal loaded radially against the inner diameter of the first stator inner shroud. While the present invention also is a radially loaded arrangement, it is considered to be a superior arrangement to that shown with respect to several drawbacks of that prior art arrangement. These drawbacks include excessive leakage through the seal to the shroud "smile" clearance caused by mismatch between seal segments and shroud curvatures. Also one seal is required per vane segment thus leading to many joint leaks when single vane segments are used. Finally, each joint exposes a relatively large area to the high pressure fluid to be sealed against and requires a complex segment-to-segment linkage system to seal effectively.

It is the aim of this invention to provide an improved seal arrangement which does not suffer from the noted drawbacks of the prior art arrangement.

SUMMARY OF THE INVENTION

In accordance with the invention, the arrangement for sealing between the inner shrouds and the seal housing include outer seal means carried by the housing and comprising a first plurality of arcuate segments in end-to-end relation, with each segment being generally channel-shaped in cross-section throughout its length and being radially movably disposed in the radially outwardly open channel of the seal housing, and inner seal means radially movably disposed in the outer seal means channel and including a second plurality of arcuate segments which equal the number of the shrouds, and first resilient means biasing the outer seal means radially outwardly in the seal housing channel, and second resilient means independently biasing the inner seal means radially outwardly in the outer seal means channel.

Further particular details contemplated by the invention in its preferred form will be described hereinafter.

BRIEF DESCRIPTION OF THE DRAWINGS

FIG. 2 is a cross-sectional view corresponding to one taken along the line II—II of FIG. 1;

FIG. 3 is a cross-sectional view corresponding to one taken along the line III—III of FIG. 1.

DESCRIPTION OF THE PREFERRED EMBODIMENT

Figure 1:
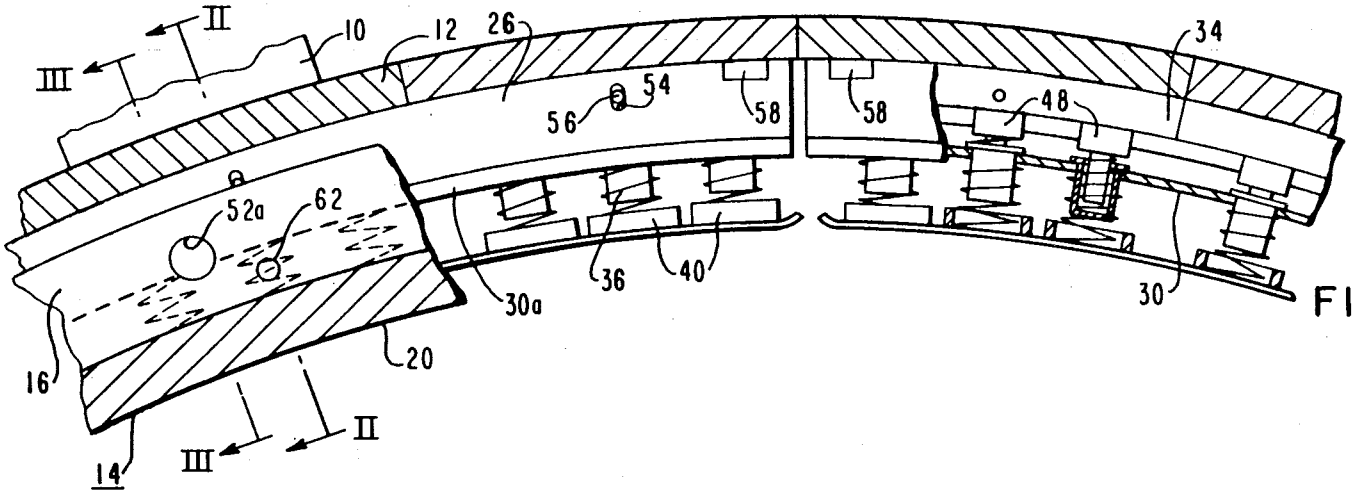
FIG. 1 is a partly broken and fragmentary face view of the seal arrangement according to the invention, this view looking in the direction of flow through the turbine.

Referring to FIG. 1, that portion of a gas turbine including an annular array of individual stator vane segments includes a portion of blades or vanes 10 which, in conventional fashion, are secured between outer shrouds (not shown) and inner shrouds 12.

As noted before, the invention deals with an arrangement providing a static seal between the radially inner surfaces of the inner shrouds 12, and radially inner structure including the annular seal housing generally designated 14.

The portions of the seal housing 14 (FIGS. 2, 3) of interest in connection with the invention include an upstream wall 16, a downstream wall 18, and a radially inner, base wall 20 together forming a radially outwardly open channel 22 which extends circumferentially. Each of the walls 16 and 18 have inwardly projecting shoulders 16*a* and 18*a*, respectively, adjacent the radially outer opening of the channel.

Received within the channel 22 (FIGS. 2 and 3) are a plurality of outer seal segments generally designated 24, and each of which is arcuately shaped in a longitudinal direction and, as best seen in FIGS. 2 and 3, are generally channel-shaped in cross-section and include an upstream wall 26, a downstream wall 28, and a web or base wall 30. The base wall 30 has upstream projecting, and downstream projecting rails 30*a* and 30*b*, respectively, which, during assembly, prevent the disengagement of the outer seal segments from the channel 22 of the seal housing.

As an example, and for purposes of illustration and description only, one gas turbine of the assignee of this application has twenty-eight individual stator vane segments and correspondingly twenty-eight individual inner shrouds 12 against which a seal is to be maintained. Thus, with the twenty-eight inner shrouds in an annular array making a complete circle, each quadrant of the circle will have seven vane segments. For purposes of manufacture and assembly, a quadrant is provided with two outer seal members, one of which corresponds in length to provide sealing against the radially inner faces of three inner shrouds, while the other outer seal segment for the quadrant has a length to provide sealing against four inner faces of the inner shrouds. Thus, a total of eight outer seal segments in end-to-end relation provide a substantially complete circle.

The second or inner seal means generally designated 32 are disposed in the channel 33 of the first seal means and include a plurality of arcuate seal segments 34, equal in number to the number of inner shrouds of the stator vanes and, as disposed in end-to-end relation, substantially complete a circle.

The outer seal means 24 is biased radially outwardly in the seal housing channel 22, while the inner seal means is independently biased radially outwardly in the first seal means channel 33. In the preferred form of the invention, the outward biasing is accomplished by sets of compression springs 36 and 38 which, are concentrically arranged relative to each other. The arrangement includes a series of circumferentially spaced, radially outwardly open cups 40 supported from the base wall 20 of the seal housing and into which one compression spring 36 is received, with the opposite end of the spring bearing against the base wall 30 of the outer seal. At circumferentially correspondingly spaced locations along the length of the outer seal segments, openings 42

ıre provided in the base wall of the outer seal, and a himble-shaped member 44 is received in each opening. The diametrically smaller compression spring 38 is re-:eived in the thimble 44. The bore of the inner spring 38 'eceives the shank 46 of a button 48 which has a base ırea greater than the area of the spring 38 so that the 'adially outer end of the spring 38 will bear against the ›utton 48 to urge it in a radially outward direction. The 'aces of the buttons, and the opposing faces of the inner :eal segments 34 are complementarily inclined relative o each other, as is readily seen in FIG. 2, so that the ›uttons 48 and segments 34 are urged in opposite axial lirections (relative to the axis of the turbine) under the 'orce of the spring 38 before start-up, and by the pres-:ure differential holding segments 34 downstream when he unit runs. To the end of accomplishing this and to ›revent binding, the axial dimensions of both the button ınd the inner seal segment 34 are less than the width of he channel 33 of the outer seals 24. Thus, this arrange-nent provides the necessary clearance to avoid binding ınder the temperature changes encountered, but still ›rovides the sealing of the segments 34 against the fac-ng downstream wall of the channel 33.

In the currently preferred embodiment, three com-›ression spring sets are provided for each single inner :eal segment 34 so, the shorter outer seal segment ac-:ommodating three of the inner seal segments will have ı total of nine compression spring sets, while the longer ›uter seal segment accommodating four of the inner :eal segments will have twelve compression spring sets.

At a number of circumferentially spaced locations, neans are provided to prevent circumferential move-nent of the outer seals relative to the seal housing. As ›est seen in FIG. 3, this is accomplished by providing an ıpstream facing slot 50 in a lower portion of the up-:tream wall 26 of the outer seal means, and providing a 'etaining screw 52 inserted through a bore in the up-:tream wall 16 of the seal housing so that the end of the 'etaining screw is received in the slot.

In the currently preferred form of the invention, neans is also provided to prevent circumferential novement of the inner seal segments 34 relative to the ›uter seal 24, while permitting limited radial movement ›f the inner seal 34 relative thereto. To this end, a radi-ılly extending slot 54 (FIGS. 1 and 2) is provided in the ıpstream wall 26 of the outer seal 24 at a location corre-:ponding to the lengthwise center of each of the inner :eals 34. Then a pin 56 is provided at that location of :ach inner seal segment 34 with its upstream end pro-ecting into the slot 54.

Each of the outer seal means is also provided with a :lot 58 (FIG. 1) at the upper end of the upstream wall 26 ınd adjacent each of its longitudinal ends to permit the nsertion of a tool to retract the seals during disassembly ınd service.

Figure 4:
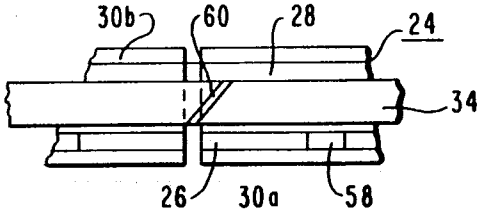
FIG. 4 is a fragmentary edge view of the seal arrangement of the invention at a joint between outer seal segments.

The relation of the opposing ends of the outer seals to :ach other and of the inner seals to each other is best :een in FIG. 4. As there shown, the ends of the outer :eals may, for example, have their ends squared off, vhile the inner seal segments 34 have their ends com-›lementarily inclined as at 60.

The arrangement is considered to have a number of ıdvantages. For example, the continuous channel 33 of he outer seal results in the outer seal part being rela-ively simple to manufacture. The outer seals span a ıumber of inner shrouds and are loaded against the :hrouds to provide a part of the seal. To the extent that individual inner shrouds are skewed or misaligned with respect to a perfect circle, the inner seal segments 34 individually span individual inner shrouds and enhance the sealing contact. The sealing force of the outer seal is partly from the outer spring 36, but is for the most part obtained through pressurization of the channel 22 by means of a series of circumferentially spaced openings 62 in the front wall 16 of the seal housing. This pressure loading of an outer seal is known in the prior art as evidenced in the noted patent. The inner seal segments 34 are independently loaded partly by the internal springs 38 but primarily by pressure forces to insure good sealing contact with the inner faces of the individual inner shrouds.

We claim:

1. An arrangement for statically sealing between the inner shrouds of an annular array of stationary stator vanes and a radially-inner, annular seal housing of a gas turbine, comprising:

first, outer seal means carried by said housing and comprising a first plurality of arcuate segments in end-to-end relation substantially completing a circle, each said segment being generally channel-shaped in cross section throughout its length, and being radially movably disposed in a radially-outwardly-open channel in said housing;

second, inner seal means radially movably disposed in said first seal means channel and including a second plurality of arcuate segments equalling the number of said shrouds, in end-to-end relation substantially completing a circle;

first resilient means biasing said first seal means radially outwardly in said housing channel; and second resilient means independently biasing said second seal means radially outwardly in said first seal means channel.

2. An arrangement according to claim 1 wherein:

each outer seal segment spans at least two inner seal segments.

3. An arrangement according to claim 1 wherein:

said first resilient means comprise a first series of compression springs spaced along the length of each outer seal segment; and said second resilient means comprise a second series of compression springs, of lesser diameter than said first compression springs and concentrically received therein, and spaced along the length of each inner seal segment.

4. An arrangement according to claim 1 wherein:

each inner seal segment comprises a radially inner part, and a separate radially outer part, said inner and outer parts having complementarily inclined opposing faces to that said parts are urged in opposite axial directions by said second resilient means.

5. An arrangement according to claim 4 wherein:

said inclined opposing faces are disposed relative to each other that said outer part is urged in a downstream direction relative to airflow.

6. An arrangement according to claim 1 including:

radially extending slot means in said outer seal means and pin means carried by said inner seal means received therein to prevent disengagement of said second seal means from said first seal means while permitting limited radial movement of said inner seal means relative to said outer seal means.

* * * * *